US010294743B2

(12) United States Patent
Kartha et al.

(10) Patent No.: US 10,294,743 B2
(45) Date of Patent: May 21, 2019

(54) DEVICES AND METHODS FOR ANCHORING THE TOOLS IN A WELLBORE CASING SECTION

(71) Applicant: HALLIBURTON ENERGY SERVICES, INC., Houston, TX (US)

(72) Inventors: Nikhil M. Kartha, Singapore (SG); Mark S. Holly, Houston, TX (US); Sean Gregory Thomas, Allen, TX (US); Jack Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 245 days.

(21) Appl. No.: 15/302,464

(22) PCT Filed: May 6, 2014

(86) PCT No.: PCT/US2014/037007
§ 371 (c)(1),
(2) Date: Oct. 6, 2016

(87) PCT Pub. No.: WO2015/171123
PCT Pub. Date: Nov. 12, 2015

(65) Prior Publication Data
US 2017/0016295 A1 Jan. 19, 2017

(51) Int. Cl.
*E21B 23/01* (2006.01)
*E21B 23/00* (2006.01)
(Continued)

(52) U.S. Cl.
CPC ..... *E21B 23/01* (2013.01); *E21B 23/06* (2013.01); *E21B 33/10* (2013.01); *E21B 17/20* (2013.01); *E21B 33/12* (2013.01); *E21B 49/00* (2013.01)

(58) Field of Classification Search
CPC ..... E21B 23/01; E21B 23/00
See application file for complete search history.

(56) References Cited

U.S. PATENT DOCUMENTS 4,499,799 A 2/1985 Bordages
4,811,785 A 3/1989 Weber
(Continued)

OTHER PUBLICATIONS

Billingham et al., "Conveyance—Down and Out in the Oil Field", Oilfield Review, vol. 23, No. 2, Summer 2011.
(Continued)

*Primary Examiner* — Catherine Loikith
(74) *Attorney, Agent, or Firm* — Locke Lord LLP

(57) ABSTRACT

The disclosure provides a downhole anchoring apparatus for use in a downhole tool. An example downhole anchoring apparatus may include a housing with a hub provided within the housing. The hub may be arranged to rotate in a bidirectional fashion about a longitudinal axis. The downhole anchoring apparatus may also include a deployment linkage. The deployment linkage may be coupled to the hub by a hinge so that when the hub is rotated in a first direction, a distal end of the deployment linkage is extended radially outward from the central axis, and when the hub is rotated in a second direction, the distal end of the deployment linkage is retracted toward the central axis.

14 Claims, 3 Drawing Sheets

(51) Int. Cl.

| | |
|---|---|
| ***E21B 33/10*** | (2006.01) |
| ***E21B 23/06*** | (2006.01) |
| *E21B 17/20* | (2006.01) |
| *E21B 33/12* | (2006.01) |
| *E21B 49/00* | (2006.01) |

(56) References Cited

U.S. PATENT DOCUMENTS

| | | | | |
|---|---|---|---|---|
| 5,771,970 | A * | 6/1998 | Jani | E21B 23/00 166/216 |
| 6,155,346 | A * | 12/2000 | Aldridge | E21B 23/01 166/216 |
| 6,311,778 | B1 | 11/2001 | Carisella et al. | |
| 2005/0263280 | A1 | 12/2005 | Sellers et al. | |
| 2009/0071659 | A1 | 3/2009 | Spencer et al. | |

OTHER PUBLICATIONS

Park, Tae Wook, PCT Search Report for PCT Application No. PCT/US2014/037007 dated Feb. 5, 2015.

Park, Tae Wook, PCT Written Opinion for PCT Application No. PCT/US2014/037007 dated Feb. 5, 2015.

* cited by examiner

DEVICES AND METHODS FOR ANCHORING THE TOOLS IN A WELLBORE CASING SECTION

TECHNICAL FIELD

The embodiments disclosed herein relate generally to downhole tools for oil and gas wells, and, in particular to devices and methods for anchoring the tools in a wellbore casing section.

BACKGROUND

Downhole tools are often used to provide operations in oil and gas wells. Wirelines or slicklines are used to position downhole tools at a desired location in the wellbore. The desired location in the wellbore may be either cased or uncased, depending on the nature of the operation to be performed by the tool. In order to perform the desired operation, many wireline or slickline tools must be anchored in the wellbore to hold them in the correction wellbore location. This means the anchor must be able to resist not only unwanted movement of the tool in the axial direction, but also rotational movement caused by torque on the tool during the operation.

DETAILED DESCRIPTION OF DISCLOSED EMBODIMENTS

As an initial matter, it will be appreciated that the development of an actual, real commercial application incorporating aspects of the disclosed embodiments will require many implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the disclosure.

Figure 1:
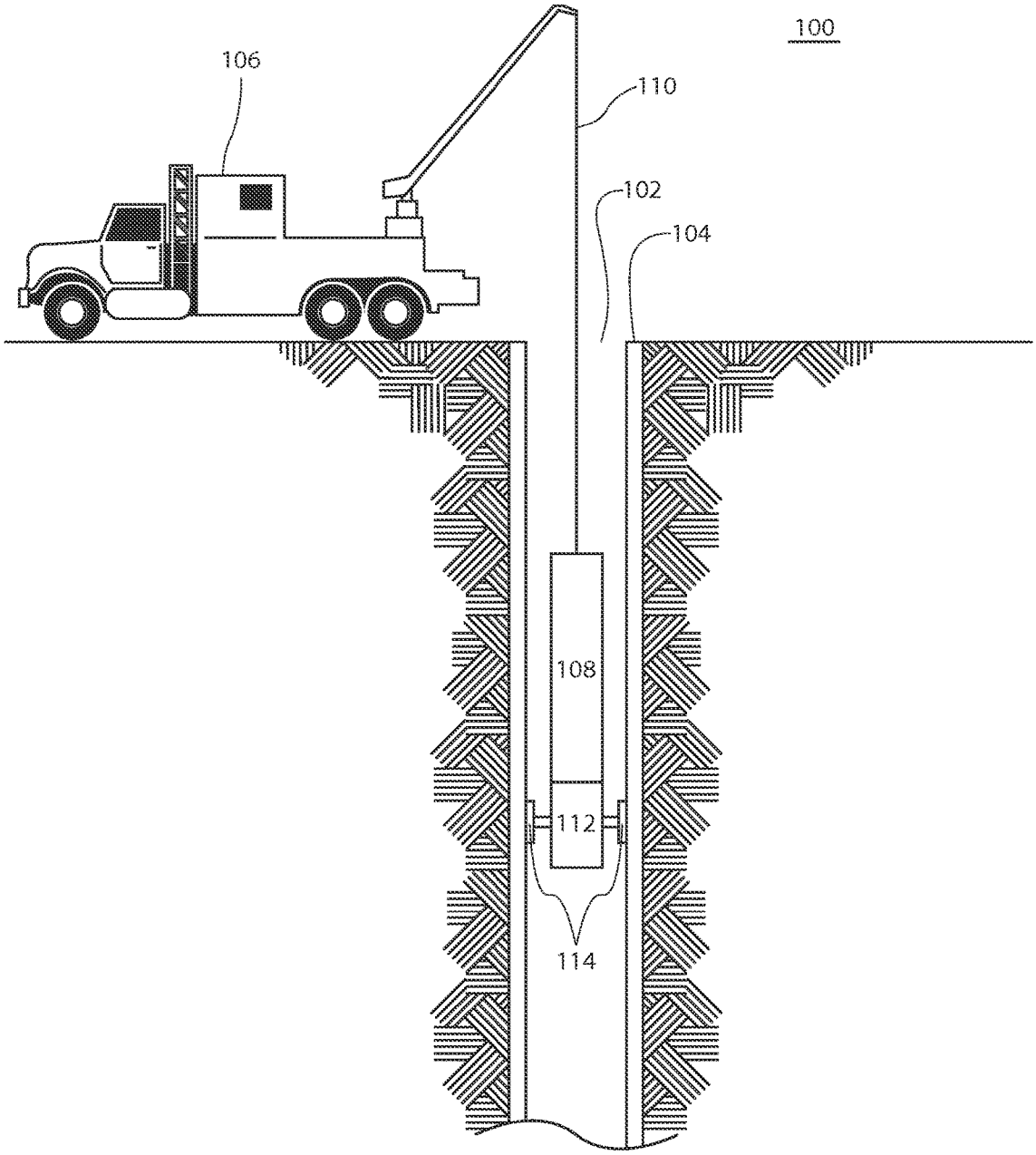
FIG. 1 is a diagram showing a downhole anchoring system according to an embodiment.

In one embodiment of the disclosure, there is provided a downhole anchor for anchoring a downhole tool in a desired section of the wellbore. FIG. 1 shows an anchoring system 100 according to an embodiment of the disclosure. Wellbore 102 of an oil and gas well is lined with casing 104. A wireline truck 106 may be used to deploy activation tool 108 at a desired location within wellbore 102 from wireline 110. An activation tool can be any type of downhole tool that is activated downhole to perform a desired operation. Examples of actuation tools include any number of well intervention tools, such, as tools for setting packers, washing tools, milling tools, data gathering or sampling tools, and so forth. Generally, any downhole tool that requires anchoring may be used in embodiments of the system. Further, one or more anchors may be provided as necessary to maintain the activation tool in place. Similarly, in other embodiments, more than one activation tool may be included in the work string. For simplicity, in the embodiment depicted in FIG. 1, a single anchor 112 is provided to hold activation tool 108 in place. Anchor 112 includes radially extending linkages 114 that cause slips to engage the inner surface of wellbore casing 104 with sufficient force to hold activation tool 108 in place.

Figure 2:
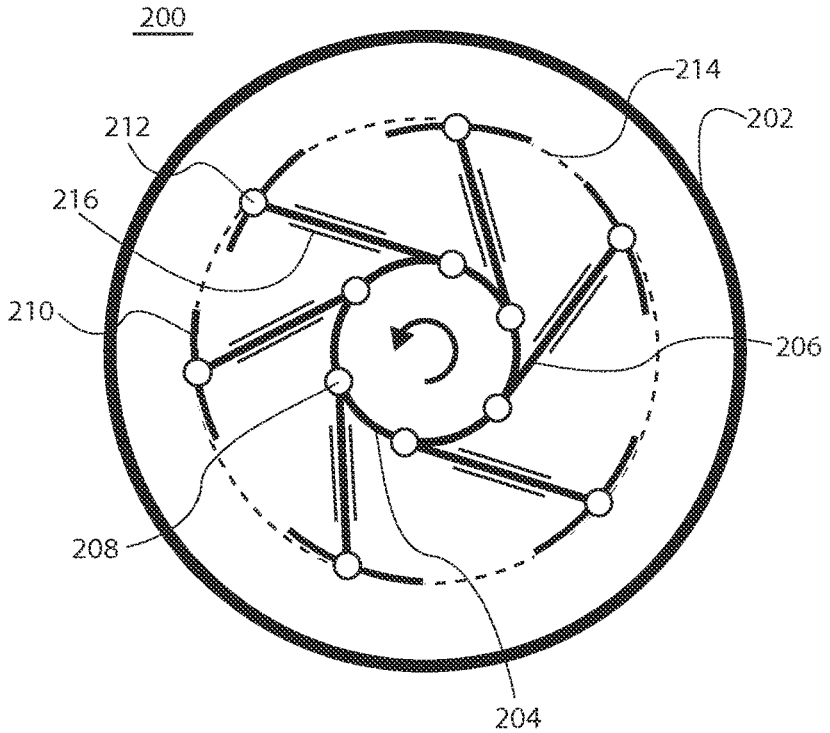
FIG. 2 is a diagram illustrating a downhole anchor according to an embodiment with the deployment linkages retracted.

FIG. 2 shows a view of an anchor according to an embodiment of the disclosure. The anchor 200 is positioned in wellbore casing 202 by a wireline truck. The anchor 200 includes a rotatable hub 204. A plurality of deployment linkages 206 are attached to the rotatable hub 204 by hinges 208. The hub 204 is designed to rotate in both the clockwise and counter-clockwise directions about a central axis. The central axis is at the center of the rotatable hub 204. The central axis runs longitudinally with the tool and is generally aligned with the longitudinal axis of the wellbore. In the embodiment shown in FIG. 1, the longitudinal axis of the wellbore 102 is depicted as being vertical, however, it will be understood that it is common to drill oil and gas wells at various inclinations, including horizontal, and that the inclination may vary at different depths. Thus, the longitudinal axis of the wellbore at a given section where the anchor is deployed may have any inclination, and is not limited to vertical.

The distal end of each deployment linkage 206 is provided with a slip 210. The slips 210 are flexible and may be constructed from metal. The outer surface of slips 210 may include surface features, such as grooves, serrations or teeth, designed to grip the inner surface of the wellbore casing. In various embodiments, the surface features may be optimized to resist torque or longitudinal movement of the tool depending on the operation the activation tool is to perform.

The hinges 208 coupling the deployment linkages 206 to the rotatable hub 204 include a pin that is oriented along the longitudinal axis, or central axis, of the anchor 200. This allows the deployment linkages 206 to pivot either clockwise or counter-clockwise, while being restricted from linear motion in a longitudinal direction. Hinges 212 are used to couple the slips 210 to the distal end of deployment linkages 206. Hinges 212 are oriented in the same matter as hinges 208, and similarly allow slips 210 to rotate either clockwise or counter-clockwise. This allows slips 210 to adjust to match the curvature of the inner surface of wellbore casing 202 so that an optimal grip may be achieved when the slips are engaged with the wellbore casing.

The embodiment shown in FIG. 2 shows an anchor 200 with the deployment linkages 206 fully retracted. This is the configuration in which the anchor 200 would be deployed into the wellbore. When the deployment linkages 206 are fully retracted, the slips 210 are drawn flush with the tool housing 214. The tool housing 214 may be provided with slots or recesses to allow the slips 210 to be flush with the housing 214. This allows the anchor 200 to travel through the wellbore to a desired section where the downhole tool is to be activated without hanging up or snagging on other equipment or objects that might be in the wellbore.

When the downhole tool is located at the desired section of the wellbore where the operation is to be performed, the anchor is deployed. To deploy the anchor 200, the rotatable hub 204 is rotated. In the embodiment shown in FIG. 2, the rotatable hub 204 is rotated counter-clockwise to extend the deployment linkages 206. The rotation may be cause by hydraulic or electromechanical equipment. The selection of the particular equipment to rotate the rotatable hub 204 is a matter of design choice and within the capabilities of one of skill in the art.

As rotatable hub 204 is rotated counter-clockwise, deployment linkages 206 are extended radially through guides 216. Guides 216 are allowed to pivot because the relative angle of the deployment linkages 206 to the rotatable hub 204 will change as they extend, and retract, radially. Allowing the guides 216 to pivot will accommodate this change in relative angle. In another embodiment, the guide 216 may be a pair of rollers or similar bearings instead of, or in combination with, a channel or slot. In some implementations, the rollers may be fixed, but still accommodate the change in relative angle.

Guides 216 cause the deployment linkages 206 to extend radially outward from the central axis of the rotatable hub 204 and toward the inner surface of the wellbore casing. Hinges 212 allow the deployment linkages 206 to pivot so that the rotational movement of rotatable hub 204 is translated into linear movement of the deployment linkages 206 in the radial direction.

Figure 3:
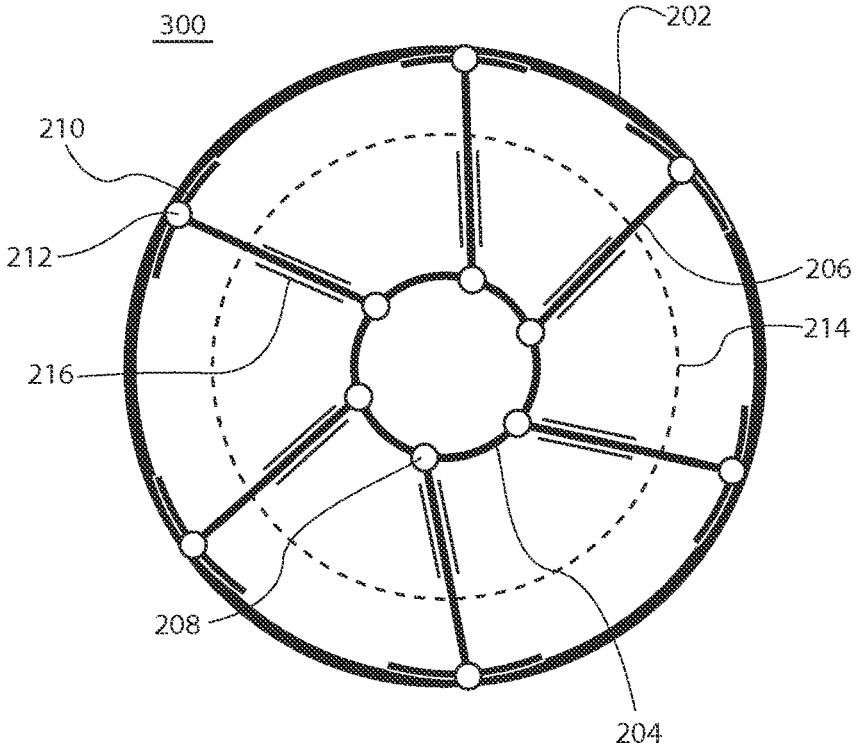
FIG. 3 is a diagram illustrating a downhole anchor according to an embodiment with the deployment linkages extended.

A deployed anchor 300 is shown in FIG. 3. Near the end of their travel, deployment linkages 206 cause slips 210 to engage the inner surface of the wellbore casing 202. Hinges 212 allow the slips 210 to adjust to fit the curved surface of the wellbore casing and grip effectively on its surface. Further rotation of rotatable hub 204 increases the force with which slips 210 are pressed against the wellbore casing. This allows well engineers to control the braking force by controlling the amount of rotation of rotatable hub 204. The radial motion of the deployment linkages 206 also allows the anchor 300 to effectively grip a range of casing diameters without any performance degradation. It further allows the anchor 300 to have a significantly higher holding resistance to torque in addition to the traditional axial direction. Because the force generated in the deployment linkages 206 can be significant, it is advantageous if deployment linkages 206 and hinges 208 are arranged so that the deployment linkages 206 transfer force to the hinge seat rather than the hinge pin.

As the anchor 300 is positioned by the wireline, the central axis of the anchor will likely not be centered with the longitudinal axis of the wellbore casing 202. It is important in many cases for the anchor 300, as well as the downhole tools it is anchoring, to be centered in the wellbore. Therefore, it is advantageous if the anchor 300 is designed to self-center when actuated. In the embodiment shown in FIGS. 2-3, self-centering is achieved by using six deployment linkages 206 arranged evenly about rotatable hub 204. In other embodiments, different numbers of deployment linkages 206, such as three, five or seven, may also be used, but it is advantageous if they are arranged so that the anchor self-centers in the wellbore casing when deployed.

Once the slips 210 are engaged with wellbore casing 202, the rotatable hub 204 can be locked into position using various known mechanisms, such as clutches or no-backs. This enables the drive mechanism to be switched off while the anchor 300 is engaged, thus saving power.

To unlock the anchor 300, the rotatable hub 204 is rotated in the opposite direction, in this example, clockwise. This causes the deployment linkages 206 to radially retract through guides 216 until they cause slips 210 to reseat into the slots or recesses in housing 214. At this point, the anchor 300, along with any downhole tools in the work string, may be withdrawn or moved to a different location in the wellbore where the anchor 300 may be again deployed.

Figure 4:
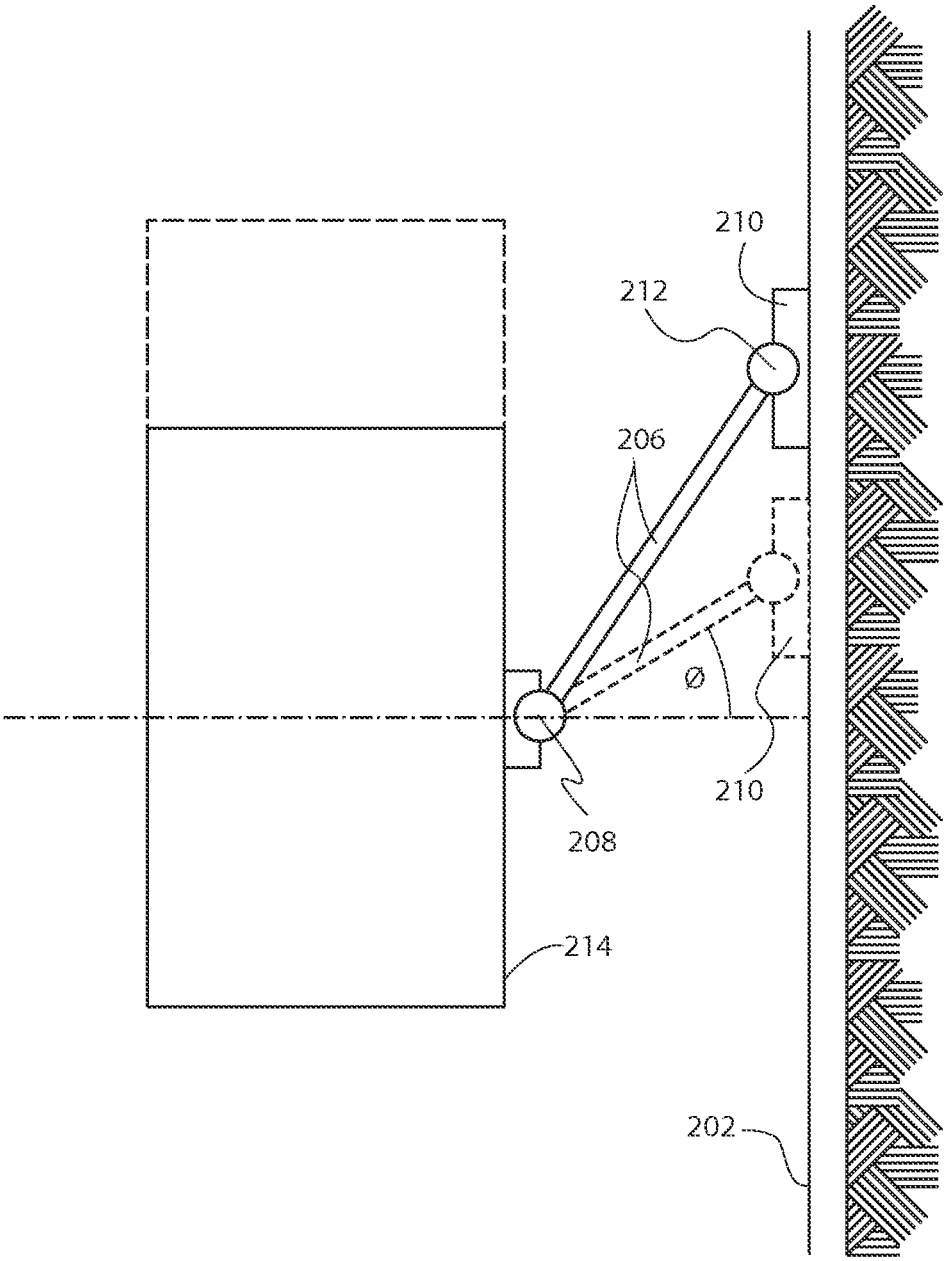
FIG. 4 is a diagram illustrating a downhole anchor according to an embodiment arranged to provide a mechanism for conveyance.

In another embodiment, the anchor may be adapted to serve as a mechanism for downhole conveyance or "tractoring." In this embodiment, the operation of the rotatable hub 204, deployment linkages 206, and slips 210 is generally as described in connection with FIGS. 1-3, however, the deployment linkages 206 are arranged to deploy at an angle, rather than a single plane that is normal to the central axis. This embodiment is depicted in FIG. 4. The deployment linkages 206 are deployed at an angle and initially meet the casing at an angle Ø , rather than a normal to the central axis. At this point housing 214 is located in in the wellbore as indicated by the dotted lines. As rotatable hub 204 is further rotated, deployment linkages 206 are further extended and the resulting force against wellbore casing 202 causes the anchor, and any downhole tools, to be driven, or "tractored," linearly along the wellbore until the deployment linkages 206 are fully extended and reach the position shown in the solid lines in FIG. 4. This operation may be repeated allowing the anchor to serve as a conveyance mechanism.

In another embodiment, the anchor 200, particularly the rotatable hub 204, may be arranged to accommodate different lengths of the deployment linkages to assist in allowing the downhole anchoring apparatus to be deployed in different size downhole casings. The deployment linkages 206 may be field-replaceable to allow the anchor 200 to be customized for different sized wellbore casing quickly and easily.

In a further embodiment of the disclosure, there is provided a downhole anchoring apparatus for use in a downhole tool. The downhole anchoring apparatus includes a housing with a rotatable hub provided within the housing. The rotatable hub may be arranged to rotate in a bi-directional fashion about a longitudinal axis. The downhole anchoring apparatus also includes a deployment linkage. The deployment linkage may be coupled to the rotatable hub by a hinge. When the rotatable hub is rotated in a first direction, a distal end of the deployment linkage is extended radially outward from the central axis. When the rotatable hub is rotated in a second direction, the distal end of the deployment linkage is retracted toward the central axis.

The downhole apparatus also includes a slip. The slip may be coupled to the distal end of the deployment linkage. Radial extension of the deployment linkage causes the slip to engage an inner surface of the wellbore casing. Retraction of the deployment linkage causes the slip to disengage the inner surface of the wellbore casing.

In some embodiments, the system may further comprise any one of the following features individually or any two or more of these features in combination: (a) a plurality of deployment linkages arranged on the rotatable hub so that the downhole anchoring apparatus self-centers in the wellbore casing when the slips engage the inner surface of the wellbore casing; (b) the rotatable hub arranged to accommodate different lengths of the deployment linkages so the downhole anchoring apparatus may be deployed in different size downhole casings; (c) the hinge coupling the rotatable hub to the deployment linkage includes a hinge seat so that when the slip engages the inner surface of the wellbore casing the compressive force in the deployment linkage is transferred to the hinge seat; (d) the housing including an opening or recess to accommodate the slip, so that when the deployment linkage is retracted, the slip is generally flush with the outer surface of the housing; (e) a guide to limit the non-radial movement of the deployment linkage, which may be, for example, a slot or channel, which may be allowed to pivot, or rollers or other bearings; and (f) the deployment linkage extends at an angle away from normal to the central axis.

In another embodiment of the disclosure provides a method for anchoring a downhole tool. In this embodiment, the method includes positioning a housing having a rotatable hub into a section of wellbore casing, in which the rotatable hub is arranged to bi-directionally rotate about a longitudinal axis. Rotating the rotatable hub in a first direction extends a deployment linkage radially outward from a central axis. The deployment linkage has a slip coupled to a distal end. The slip engages an inner surface of the wellbore casing when the rotatable hub is rotated in a first direction. The slip is disengaged from the inner surface of the wellbore casing when the rotatable hub is rotated in a second direction.

In some embodiments, the method may further comprise any one of the following features individually or any two or more of these features in combination: (a) further extending a plurality of deployment linkages when the rotatable hub is rotated so that the downhole anchoring apparatus self-centers in the wellbore casing when the slips engage the inner surface of the wellbore casing; (b) adjusting the lengths of the deployment linkages so that the downhole anchoring apparatus may be deployed in different size downhole casings; (c) transferring the compressive force in the deployment linkage when the slips are engaged with the wellbore casing to a hinge seat arranged on the rotatable hub; (d) retracting the deployment linkage into an opening or recess on the housing so that the slip is generally flush with the outer surface of the housing; (e) moving the deployment linkage through a guide that limits the non-radial movement of the deployment linkage, which may be, for example, a slot or channel, which may be allowed to pivot, or rollers or other bearings; (f) extending a plurality of deployment linkages in a manner to tractor a downhole tool along the wellbore casing; and (g) the deployment linkages extend at an angle away from normal to the central axis so that they can move the downhole tool along a longitudinal axis in the wellbore.

In still a further embodiment, a system for anchoring a downhole tool in a section of wellbore casing is provided. The system includes a downhole tool for performing an operation in the wellbore and an anchor having rotatable hub in the housing. The rotatable hub is bi-directionally rotatable about a central axis. A deployment linkage is coupled to the rotatable hub by a hinge. When the rotatable hub is rotated in a first direction, a distal end of the deployment linkage is extended radially outward from the central axis. When the rotatable hub is rotated in a second direction, the distal end of the deployment linkage is retracted toward the central axis. The system also includes a slip coupled to the distal end of the deployment linkage, which engages an inner surface of the wellbore casing when the deployment linkage is extended, and which disengages the inner surface of the wellbore casing when the deployment linkage is retracted.

In some embodiments, the system may further comprise any one of the following features individually or any two or more of these features in combination: (a) a plurality of deployment linkages arranged on the rotatable hub so that the anchor self-centers in the wellbore casing when the slips engage the inner surface of the wellbore casing; (b) the rotatable hub arranged to accommodate different lengths of the deployment linkages so the anchor may be deployed in different size downhole casings; (c) the hinge coupling the rotatable hub to the deployment linkage comprises a hinge seat so that when the slip engages the inner surface of the wellbore casing the compressive force in the deployment linkage is transferred to the hinge seat; (d) the housing comprises an opening or recess to accommodate the slip, so that when the deployment linkage is retracted, the slip is generally flush with the outer surface of the housing; (e) a guide to limit the non-radial movement of the deployment linkage, which may be, for example, a slot or channel, which may be allowed to pivot, or rollers or other bearings; and (f) the deployment linkages extend at an angle away from normal to the central axis.

While the disclosed embodiments have been described with reference to one or more particular implementations, those skilled in the art will recognize that many changes may be made thereto without departing from the spirit and scope of the description. Accordingly, each of these embodiments and obvious variations thereof is contemplated as falling within the spirit and scope of the following claims.

What is claimed is:

1. A downhole anchoring apparatus for use in a downhole tool, the downhole anchoring apparatus comprising:

a housing;

a hub rotatably arranged on a longitudinal axis in the housing;

a deployment linkage coupled to the hub by a hinge so that a distal end of the deployment linkage extends radially outward from the longitudinal axis as the hub is rotated in a first direction and radially retracts toward the longitudinal axis as the hub is rotated in a second direction;

a slip coupled to the distal end of the deployment linkage that engages an inner surface of a wellbore casing in response to radial extension of the deployment linkage and disengages the inner surface of the wellbore in response to retraction of the deployment linkage; and a guide that limits the non-radial movement of the deployment linkage, the guide comprising a channel, a slot, or a roller that pivots relative to the angle of the deployment linkage.

2. The downhole anchoring apparatus according to claim 1, further comprising a plurality of deployment linkages arranged on the hub so that the downhole anchoring apparatus self-centers in the wellbore casing when the slips engage the inner surface of the wellbore casing.

3. The downhole anchoring apparatus according to claim 2, wherein the hub is arranged to accommodate different lengths of the deployment linkages so the downhole anchoring apparatus may be deployed in different size downhole casings.

4. The downhole anchoring apparatus according to claim 1, wherein the hinge coupling the hub to the deployment linkage comprises a hinge seat.

5. The downhole anchoring apparatus according to claim 1, wherein the deployment linkage extends at an angle away from a normal to the longitudinal axis.

6. A method for anchoring a downhole tool, the method comprising:

positioning a housing having a hub arranged to bi-directionally rotate about a longitudinal axis of the downhole tool into a section of wellbore casing;

rotating the hub in a first direction to extend a deployment linkage radially outward from the longitudinal axis, the deployment linkage having a slip coupled to a distal end of the deployment linkage, wherein the slip engages an inner surface of the wellbore casing when the hub is rotated in the first direction;

moving the deployment linkage through a guide that limits the non-radial movement of the deployment linkage, the guide comprising a channel, a slot, or a roller that pivots relative to the angle of the deployment linkage; and wherein the slip is disengaged from the inner surface of the wellbore casing when the hub is rotated in a second direction.

7. The method according to claim 6, further comprising extending a plurality of deployment linkages when the hub is rotated so that the downhole anchoring apparatus self-centers in the wellbore casing when the slips engage the inner surface of the wellbore casing.

8. The method according to claim 7, further comprising adjusting the lengths of the deployment linkages so that the downhole anchoring apparatus may be deployed in different size downhole casings.

9. The method according to claim 6, further comprising extending the deployment linkages at an angle away from a normal to the central axis to move the downhole tool along a longitudinal axis in the wellbore.

10. A system for anchoring a downhole tool in a section of wellbore casing, the system comprising:

a downhole tool for performing an operation in a wellbore;

an anchor having a bidirectionally rotatable hub arranged on a longitudinal axis of a housing;

a deployment linkage connected to the hub by a hinge, wherein when the hub is rotated in a first direction, a distal end of the deployment linkage is extended radially outward from the longitudinal axis, and when the hub is rotated in a second direction the distal end of the deployment linkage is retracted toward the longitudinal axis;

a slip coupled to the distal end of the deployment linkage, which engages an inner surface of a wellbore casing when the deployment linkage is extended, and which disengages the inner surface of the wellbore casing when the deployment linkage is retracted; and a guide that limits the non-radial movement of the deployment linkage, the guide comprising a pivot.

11. The system according to claim 10, further comprising a plurality of deployment linkages arranged on the hub so that the anchor self-centers in the wellbore casing when the slips engage the inner surface of the wellbore casing.

12. The system according to claim 11, wherein the hub is arranged to accommodate different lengths of the deployment linkages so the anchor may be deployed in different size downhole casings.

13. The system according to claim 10, wherein the guide comprises a channel, a slot or a roller that limits the non-radial movement of the deployment linkage.

14. The system according to claim 10, further wherein the deployment linkages extend at an angle away from a normal to the longitudinal axis.

* * * * *